US006094757A

United States Patent [19]

Torres

[11] Patent Number: 6,094,757

[45] Date of Patent: Aug. 1, 2000

[54] THRESHOLD ASSEMBLY FOR BARRIER FREE SHOWER UNITS

[75] Inventor: Raymond C. Torres, Moreno Valley, Calif.

[73] Assignee: Tomkins Industries, Inc., Dayton, Ohio

[21] Appl. No.: 09/280,336

[22] Filed: Mar. 29, 1999

Related U.S. Application Data

[60] Provisional application No. 60/081,833, Apr. 15, 1998.

[51] Int. Cl.[7] ..... A47K 3/22

[52] U.S. Cl. ..... 4/613; 49/467; 52/34

[58] Field of Search ..... 4/604, 612–614, 4/596; 49/467–469; 52/34

[56] References Cited

U.S. PATENT DOCUMENTS

| | | | |
|---|---|---|---|
| D. 362,490 | 9/1995 | McAllister et al. . | |
| 2,851,744 | 9/1958 | Oehmig | 49/467 |
| 3,991,537 | 11/1976 | Brown | 49/467 |
| 4,387,535 | 6/1983 | Corbo | 49/468 |
| 4,551,870 | 11/1985 | Presti, Jr. . | |
| 4,899,402 | 2/1990 | Maynard et al. . | |
| 5,056,169 | 10/1991 | Roguebrune . | |
| 5,361,428 | 11/1994 | Nanowsky et al. . | |
| 5,463,780 | 11/1995 | McAllister, Jr. et al. . | |
| 5,561,955 | 10/1996 | Frosbosilo et al. | 49/468 |
| 5,581,949 | 12/1996 | Wu | 49/467 |
| 5,673,517 | 10/1997 | Stanclift | 49/468 |
| 6,006,375 | 12/1999 | Carr | 4/613 |

FOREIGN PATENT DOCUMENTS

| | | | |
|---|---|---|---|
| 3844486 | 1/1980 | Germany | 4/614 |
| 2024910 | 1/1980 | United Kingdom | 4/596 |

*Primary Examiner*—Charles R. Eloshway
*Attorney, Agent, or Firm*—Biebel & French

[57] ABSTRACT

A threshold assembly adapted to be mounted at the threshold of a conventional barrier free shower in order to reduce the amount of water from the shower contacting the floor of the bathroom. The threshold assembly includes cooperating catch and cap members extending longitudinally across the threshold of the shower. A locking device extends between the catch and cap members for facilitating retention of the cap member on the catch member.

8 Claims, 4 Drawing Sheets

THRESHOLD ASSEMBLY FOR BARRIER FREE SHOWER UNITS

PRIOR PROVISIONAL APPLICATION

Applicant claims the benefit of the filing date of Provisional Application Ser. No. 60/081,833, filed Apr. 15, 1998.

BACKGROUND OF THE INVENTION

The present invention relates to an accessory for an assisted care shower and, more particularly, to a removable dam or threshold assembly adapted to be attached to an assisted care shower.

Assisted care showers are constructed as barrier free showers typically made from fiberglass or acrylic, and are designed to permit access to persons in wheelchairs or others who may have difficulty entering a conventional shower structure. The barrier free shower generally has a front entry side which is flush with the bathroom floor and which may include a slight slope to a drain to facilitate retention of the water within the shower. However, such showers are typically inefficient at retaining water within the shower area, such that a common problem encountered with such showers is the spraying and collection of water on the bathroom floor outside of the shower.

In certain environments, such as assisted care facilities for the elderly, the shower facilities are designed to comply with the Americans with Disabilities Act (ADA) and therefore barrier free shower facilities are provided regardless of the requirements of the resident. Often, the current resident in such a facility is not restricted in movement and does not require a full barrier free shower. Accordingly, there is a need for an attachment for such a shower which facilitates retention of water within the shower, and which also may be removed to permit barrier free access to the shower in the event that the access requirements of the resident changes or if another resident moves into the dwelling.

SUMMARY OF THE INVENTION

The present invention provides a threshold assembly adapted to be mounted at the threshold of a conventional barrier free shower in order to reduce the amount of water that splashes onto the floor of the bathroom. The threshold assembly includes a lower catch member which is attached to the existing shower. The catch member comprises an upwardly facing elongated U-shaped member longitudinally extending along the length of the shower threshold. A cap member comprising a downwardly facing elongated U-shaped member is positioned over and in parallel relation to the catch member to thereby complete the assembly. A locking device is provided between the catch member and the cap member for releasably securing the cap member to the catch member. More particularly, the locking device comprises a compression taper fit between the catch member and the cap member for facilitating retention of the cap member on the catch member.

DETAILED DESCRIPTION OF THE PREFERRED EMBODIMENT

Figure 1:
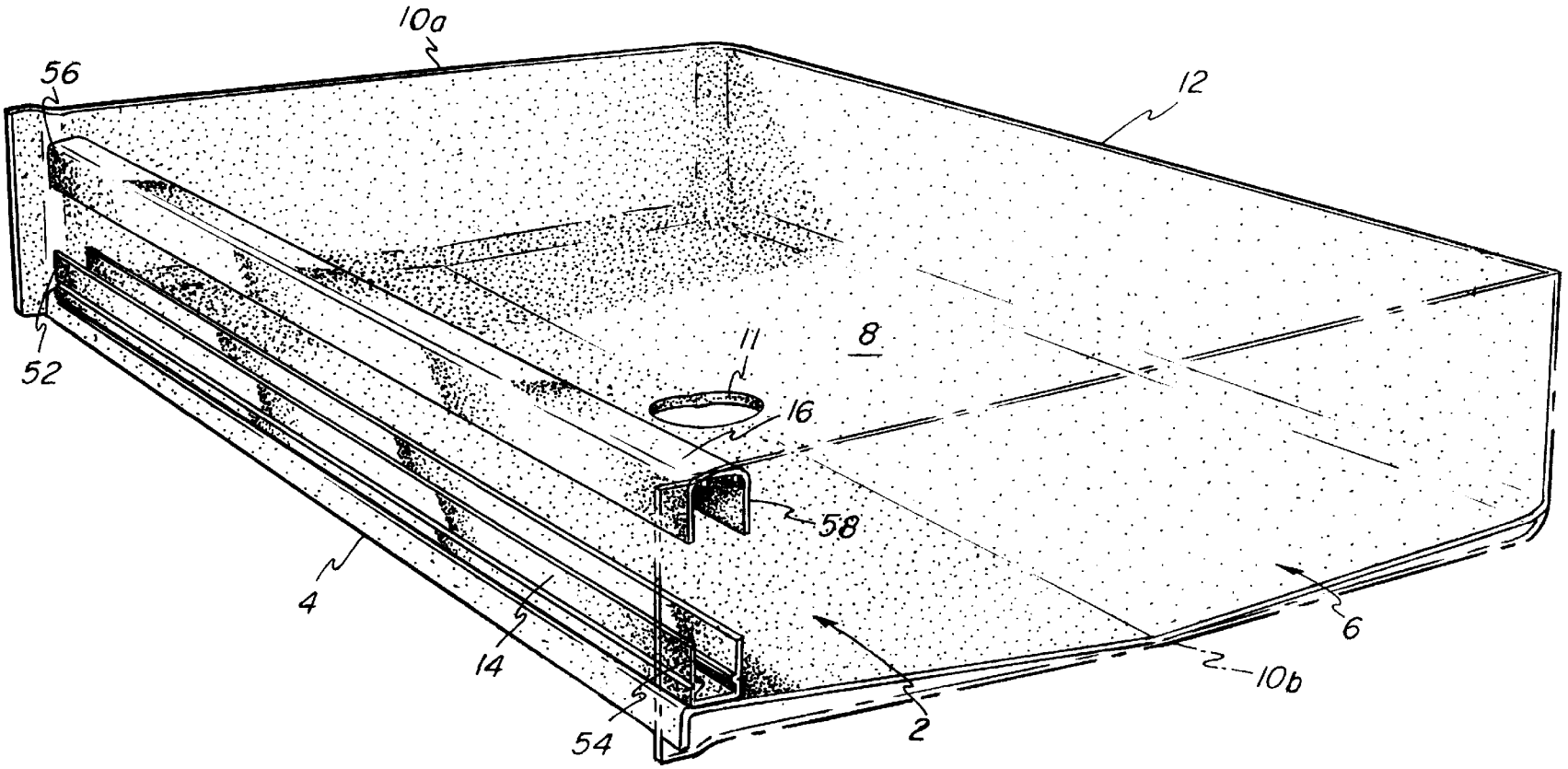
FIG. 1 is a perspective view showing a shower unit with the threshold assembly of the present invention partially installed.
Figure 2:
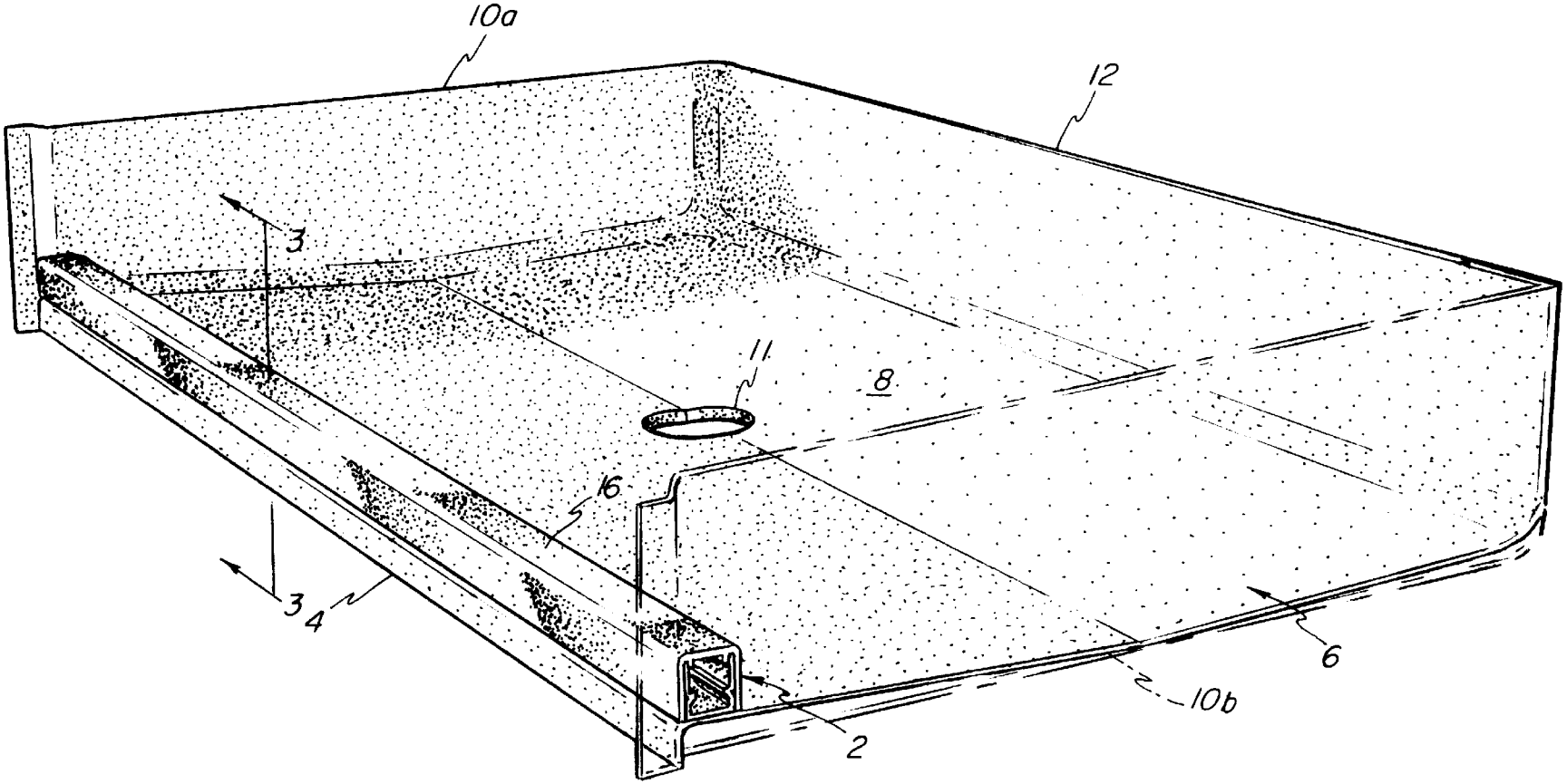
FIG. 2 is a perspective view showing a shower unit with the installation of the threshold assembly of the present invention complete.

Referring initially to FIGS. 1 and 2, the present invention relates to a threshold assembly 2 which is adapted to be mounted at the threshold 4 of a barrier-free shower unit 6. The barrier free shower unit 6 includes a base 8 and upwardly extending side walls 10*a,* 10*b* spaced apart by an upwardly extending rear wall 12. The base 8 gradually slopes toward a centrally disposed drain II to assist in the removal of water from the shower unit 6. The threshold 4 is defined by the base 8 extending between the laterally spaced side walls 10*a,* 10*b* and opposite the rear wall 12. The shower unit 6 may comprise any of a wide variety of barrier free shower readily available on the market, including those made from fiberglass or acrylic.

The threshold assembly 2 includes an upwardly facing U-shaped catch member 14 and a downwardly facing U-shaped cap member 16. The catch member 14 and cap member 16 are preferably formed of ABS, polyvinylchloride (PVC) or similar extruded material, and are designed to fit across the thresholds 4 of all conventional barrier free showers.

Figure 3:
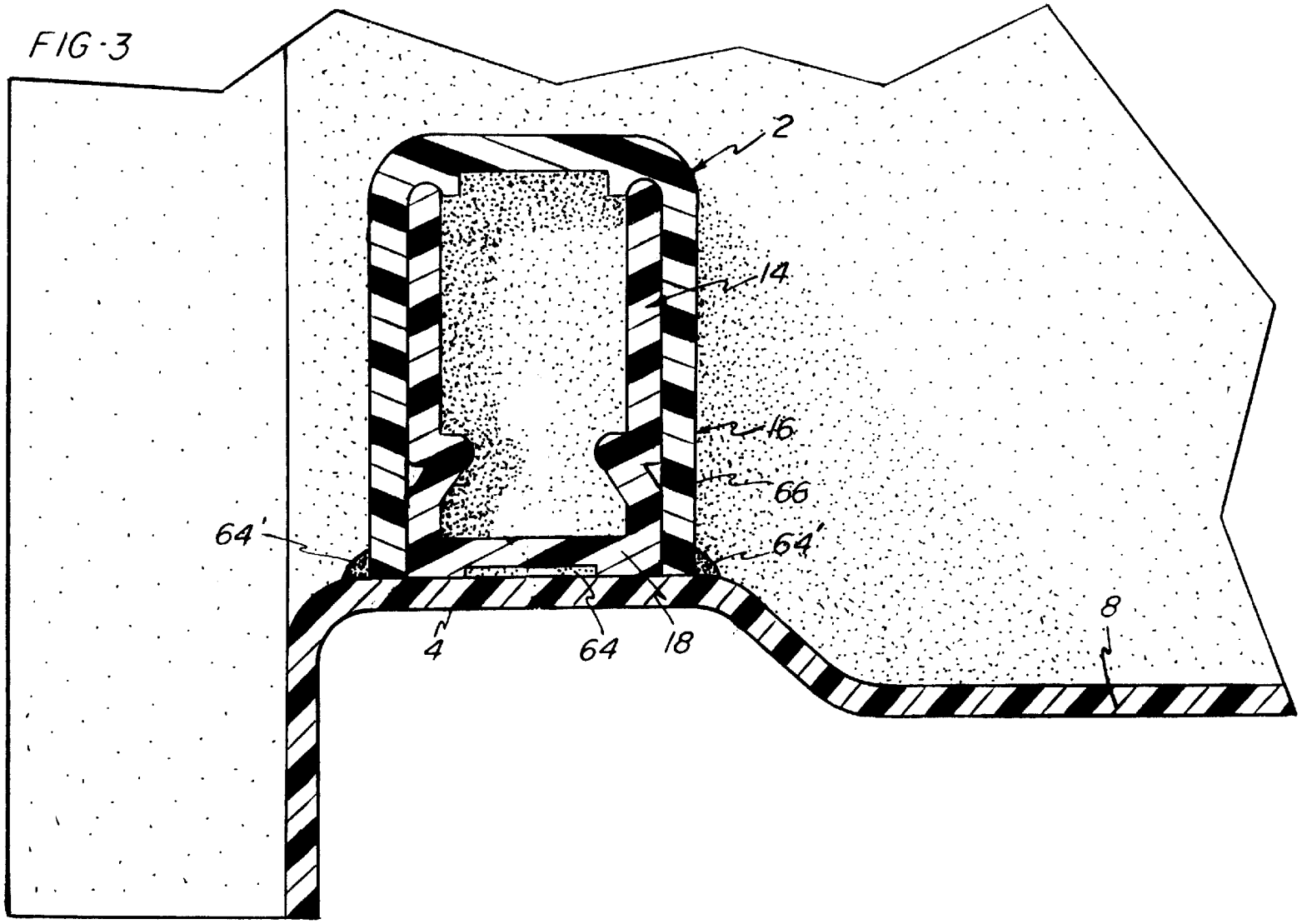
FIG. 3 is a cross-sectional view taken along line 3—3 of FIG. 2 showing the installation of the threshold assembly on a shower unit.
Figure 5:
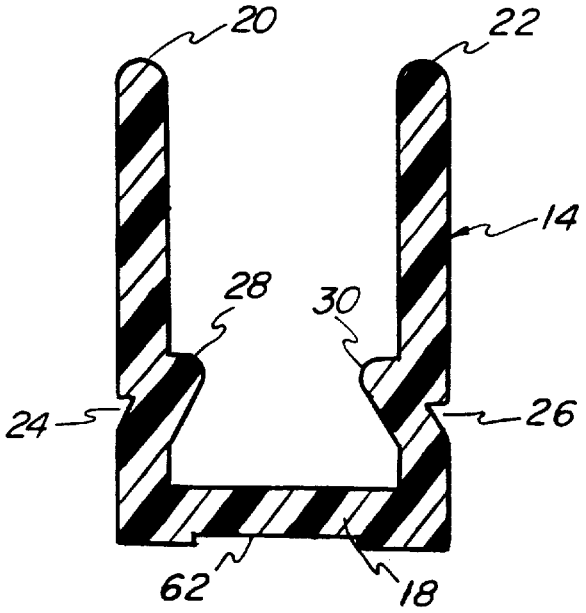
FIG. 5 is a cross-sectional view of the catch member of the present invention.

Turning now to FIG. 3 and 5, the catch member 14 includes a central horizontal portion 18 and upwardly extending first and second legs 20, 22. The horizontal portion 18 includes a recess area 62, and each of the legs 20, 22 includes a respective catch slot 24, 26, as well as inwardly extending protuberances 28, 30. The catch slots 24, 26 and protuberances 28, 30 extend longitudinally along the full length of the catch member 14 (FIG. 1).

Figure 4:
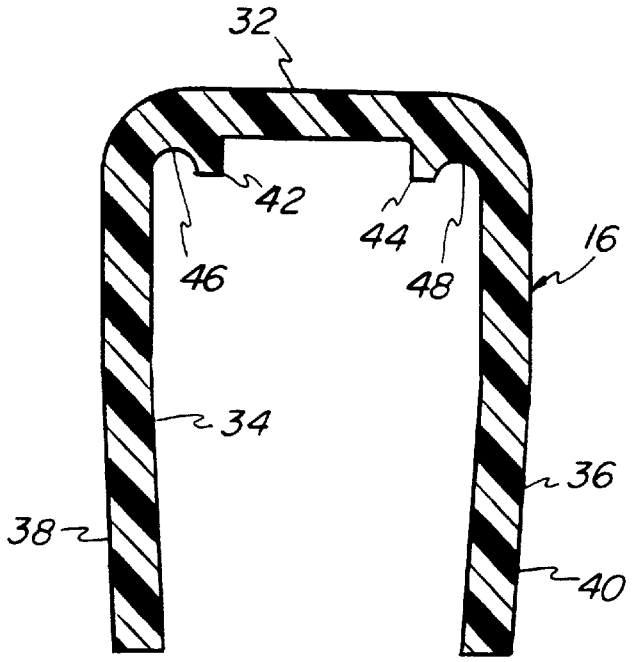
FIG. 4 is a cross-sectional view of the cap member of the present invention.

With reference to FIGS. 3 and 4, the cap member 16 is adapted to cooperate with the catch member 14 and includes a horizontal portion 32 and downwardly extending first and second legs 34, 36. The legs 34, 36 are formed with inwardly angled or tapered end portions 38, 40 such that the edges of the legs 34, 36 distal from the horizontal portion 18 are spaced closer to each other than the spacing of the legs 34, 36 proximal to the horizontal portion 18. Cooperation between the inwardly tapered end portions 38, 40 and the upwardly extending legs 20, 22 defines a locking device created by a snug compression fit between the two sets of legs 34, 36 and 20,22.

In assembly of the threshold assembly 2 to the threshold 4 of a barrier free shower unit 6, the catch member 14 and cap member 16 are initially cut to the proper length such that their respective ends 52, 54 and 56, 58 are in abutting engagement with the side walls 10*a* and 10*b* when installed across the threshold of the shower unit 6. A sealant 64, such as silicon, is applied in the recess area 62 of horizontal portion 18 to adhere the catch member 14 to the shower base 8 at the threshold 4, as well as to prevent water leakage through the joint between the catch member 14 and the shower unit 6.

Next, the cap member 16 is longitudinally aligned above the catch member 14 with the legs 34 and 36 extending downwardly and is then pushed down such that the first and second legs 34 and 36 of the cap member 16 project outside of the first and second legs 20 and 22 of the catch member 14. It should be noted that the cap member 16 includes upper ridges 42, 44 defining slots 46, 48 for receiving the ends of the upwardly extending legs 20, 22 of the catch member 14.

The ridges 42, 44 and slots 46, 48 extend longitudinally along the full length of the catch member 14. The ends of the first and second legs 20 and 22 of the catch member 14 are received within the slots 46 and 48 of the cap member 16 to assist in proper alignment of the catch and cap members 14 and 16. It should be noted that prior to assembly of the cap member 16 onto the catch member 14, sealant may be applied in the catch slots 24, 26 to facilitate retention of the cap member 16 on the catch member 14.

As may be appreciated, in addition to the cap member 16 providing an aesthetically pleasing appearance to the finished threshold assembly 2, the downwardly extending legs 34, 36 further prevent leakage of water past the threshold assembly 2. Specifically, the lower edges of the legs 34, 36 extend down toward engagement with the shower unit 6 and sealant 64' is preferably applied along the length of the junction of the legs 34, 36 and the shower unit 6 to define second and third barriers to water leakage, in addition to the barrier provided by the catch member 14. In addition, sealant is also preferably applied at the corner ends 52, 54 and 56, 58 where the assembly 2 meets the side walls 10*a* and 10*b* of the shower unit 6.

The present threshold assembly 2 is designed as a removable unit wherein the cap member 16 may be removed from the catch member 14. Removal of the cap member 16 is a matter of simply pulling the first and second legs 34 and 36 of the cap member 16 outwardly away from the first and second legs 20 and 22 of the catch member 14, and then simply pulling the cap member 16 up and away from the catch member 14. The catch member 14 may then be detached and removed from the shower unit 6, such that the shower unit 6 may again be used as a barrier free shower. This is particularly useful in the event that the user is no longer able to step over the threshold assembly 2, or if it is necessary to convert the shower unit 6 to its original configuration to accommodate a wheelchair.

It may be appreciated that the present invention provides a simple and inexpensive threshold assembly which may be easily installed and removed depending upon the needs of the individual using a barrier free shower.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A threshold assembly adapted for mounting to a threshold of a barrier free shower, said threshold assembly comprising:

a catch member adapted to extend longitudinally across a threshold of a barrier free shower, said catch member including a horizontal portion, a first leg extending upwardly from said horizontal portion and a second leg extending upwardly from said horizontal portion in spaced relation to said first leg;

a cap member cooperating with said catch member, said cap member extending longitudinally above and in parallel relation to said catch member, said cap member including a horizontal portion, a first leg extending downwardly from said horizontal portion and a second leg extending downwardly from said horizontal portion in spaced relation to said first leg; and wherein said legs of said cap member extend at an angle relative to said horizontal portion of said cap member whereby said legs of said cap member angle toward each other in a direction extending from said horizontal portion of said cap member to releasably secure said cap member to said catch member.

2. The threshold assembly of claim 1 wherein said catch member further comprises a recess area extending longitudinally along a lower surface of said horizontal portion for receiving a bead of sealant.

3. The threshold assembly of claim 1 wherein said cap member further comprises first and second slots formed within a lower surface of said horizontal portion for receiving ends of said first and second legs of said catch member.

4. A threshold assembly for mounting to the threshold of a barrier free shower, said threshold assembly comprising:

a catch member adapted to extend longitudinally across the threshold of a barrier free shower, said catch member including a horizontal portion, a first upwardly extending leg and a second upwardly extending leg disposed in spaced relation to said first upwardly extending leg;

a cap member cooperating with said catch member and extending longitudinally above and in parallel relation to said catch member, said cap member including a horizontal portion, a first downwardly extending leg and a second downwardly extending leg disposed in spaced relation to said first downwardly extending leg; and wherein said downwardly extending legs angle inwardly toward each other whereby said downwardly extending legs engage said upwardly extending legs in a snug compression fit.

5. A barrier free shower comprising:

a base;

a first side wall extending upwardly from said base;

a second side wall extending upwardly from said base and in spaced relation to said first side wall;

a catch member supported by said base and extending longitudinally between said first and second side walls in abutting relation with said first and second side walls, said catch member including a horizontal portion, a first leg extending upwardly from said horizontal portion and a second leg extending upwardly from said horizontal portion in spaced relation to said first leg;

a cap member cooperating with said catch member and extending in parallel relation to said catch member, said cap member including a horizontal portion, a first leg extending downwardly from said horizontal portion and a second leg extending downwardly in spaced relation to said first leg; and wherein said legs of said cap member extend at an angle relative to said horizontal portion of said cap member whereby said legs of said cap member angle toward each other in a direction extending from said horizontal portion of said cap member to releasably secure said cap member to said catch member.

6. The barrier free shower of claim 5 wherein said catch member further comprises a recess area extending longitudinally along a lower surface of said horizontal portion for receiving a bead of sealant. first leg.

7. The threshold assembly of claim 5 wherein said cap member further comprises first and second slots formed within a lower surface of said horizontal portion for receiving ends of said first and second legs of said catch member.

8. The threshold assembly of claim 5 wherein said legs of said cap member engage said legs of said catch member to releasably secure said cap member to said catch member in a snug compression fit.

* * * * *

UNITED STATES PATENT AND TRADEMARK OFFICE

CERTIFICATE OF CORRECTION

PATENT NO. : 6,094,757
DATED : August 1, 2000
INVENTOR(S) : Raymond C. Torres

It is certified that error appears in the above-identified patent and that said Letters Patent is hereby corrected as shown below:

Column 4,
Line 57, delete "first leg."

Signed and Sealed this

Fourth Day of September, 2001

*Attest:*

Nicholas P. Godici

NICHOLAS P. GODICI
*Acting Director of the United States Patent and Trademark Office*

*Attesting Officer*